US005895710A

United States Patent [19]

Sasse et al.

[11] Patent Number: 5,895,710

[45] Date of Patent: Apr. 20, 1999

[54] PROCESS FOR PRODUCING FINE FIBERS AND FABRICS THEREOF

[75] Inventors: Philip Anthony Sasse, Alpharetta; Richard Daniel Pike, Norcross, both of Ga.

[73] Assignee: Kimberly-Clark Worldwide, Inc., Neenah, Wis.

[21] Appl. No.: 08/677,481

[22] Filed: Jul. 10, 1996

[51] Int. Cl.[6] ..... B29C 67/00

[52] U.S. Cl. ..... 442/334; 264/171.1; 264/172.14; 264/172.17; 442/361; 442/362; 604/358

[58] Field of Search ..... 442/334, 361, 442/362; 604/358; 264/171.1, 172.14, 172.17

[56] References Cited

U.S. PATENT DOCUMENTS

| | | | |
|---|---|---|---|
| 3,692,618 | 9/1972 | Dorschner et al. | 161/72 |
| 3,802,817 | 4/1974 | Matsuki et al. | 425/66 |
| 3,932,322 | 1/1976 | Duchane | 260/17.4 |
| 3,966,865 | 6/1976 | Nishida et al. | 264/147 |
| 4,041,203 | 8/1977 | Brock et al. | 428/157 |
| 4,073,988 | 2/1978 | Nishida et al. | 428/91 |
| 4,239,720 | 12/1980 | Gerlach et al. | 264/147 |
| 4,340,563 | 7/1982 | Appel et al. | 264/518 |
| 4,361,632 | 11/1982 | Weber et al. | 429/145 |
| 4,369,156 | 1/1983 | Mathes et al. | 264/147 |
| 4,663,221 | 5/1987 | Makimura et al. | 428/224 |
| 4,767,825 | 8/1988 | Pazos et al. | 525/408 |
| 5,021,050 | 6/1991 | Iskra | 604/379 |
| 5,047,023 | 9/1991 | Berg | 604/368 |
| 5,098,423 | 3/1992 | Pieniak et al. | 604/385.1 |
| 5,102,597 | 4/1992 | Roe et al. | 264/126 |
| 5,124,188 | 6/1992 | Roe et al. | 428/72 |
| 5,188,895 | 2/1993 | Nishino et al. | 428/373 |
| 5,294,478 | 3/1994 | Wanek et al. | 428/218 |
| 5,350,370 | 9/1994 | Jackson et al. | 604/367 |
| 5,354,290 | 10/1994 | Gross | 604/367 |
| 5,382,400 | 1/1995 | Pike et al. | 264/168 |
| 5,405,698 | 4/1995 | Dugan | 428/373 |
| 5,487,860 | 1/1996 | Kent et al. | 264/103 |

FOREIGN PATENT DOCUMENTS

| | | | |
|---|---|---|---|
| 0518291A1 | 12/1992 | European Pat. Off. | A61F 13/15 |
| 85/03218 | 8/1985 | WIPO | A61F 13/18 |
| 90/14814 | 12/1990 | WIPO | A61F 13/46 |
| 90/14815 | 12/1990 | WIPO | A61F 13/52 |
| 91/10413 | 7/1991 | WIPO | A61F 5/44 |
| 91/11164 | 8/1991 | WIPO | A61F 13/46 |
| 92/11830 | 7/1992 | WIPO | A61F 13/46 |
| 92/11831 | 7/1992 | WIPO | A61F 13/46 |
| 93/04092 | 3/1993 | WIPO | C08F 2/32 |
| 93/11726 | 6/1993 | WIPO | A61F 13/15 |

OTHER PUBLICATIONS

Cowie, J. M. G., Polymers: Chemistry and Physics of Modern Materials, 1973, pp. 142–145.

*Primary Examiner*—James J. Bell
*Attorney, Agent, or Firm*—William D. Herrick

[57] ABSTRACT

The disclosed invention relates to split fibers and improved means and methods for obtaining them as well as their use in nonwovens and incorporation into personal care and other products. Multicomponent filaments are formed including at least two incompatible components. These filaments are drawn under hot aqueous, for example, steam, conditions causing them to split into fibers containing the incompatible components. These fibers are collected as a fine fiber nonwoven which finds utility as a component of sanitary napkins, diapers and other products.

24 Claims, 2 Drawing Sheets

PROCESS FOR PRODUCING FINE FIBERS AND FABRICS THEREOF

BACKGROUND OF THE INVENTION

The present invention is related to a process for producing fine denier fibers. More specifically, the invention is related to a process for producing fine denier split fibers.

Nonwoven and woven fabrics containing split or fibrillated fine fibers exhibit highly desirable properties, including textural, barrier, visual and strength properties. There are different known processes for producing split fine fibers, and in general, split fibers are produced from conjugate fibers which contain two or more incompatible polymer components or from an axially oriented film. For example, a known method for producing split fibrous structures includes the steps of forming splittable conjugate filaments into a fabric and then treating the fabric with an aqueous emulsion of benzyl alcohol or phenyl ethyl alcohol to split the conjugate filaments. Another known method has the steps of forming splittable conjugate filaments into a fibrous structure and then splitting the conjugate filaments by flexing or mechanically working the filaments in the dry state or in the presence of a hot aqueous solution. Yet another commercially utilized method for producing split fine denier fibers is a needling process. In this process, conjugate fibers are hydraulically or mechanically needled to separate the different polymer components of the conjugate fibers. Further yet another method for producing fine fibers, although it may not be a fiber splitting process, utilizes conjugate fibers that contain a solvent- or water-soluble polymer component. For example, a fibrous structure is produced from sheath-core conjugate fibers and then the fibrous structure is treated with a solvent that dissolves the sheath component to produce a fibrous structure of fine denier fibers of the core component.

Although different prior art processes, including the above described processes, for producing split or fibrillated fine denier fibers are known, each of the prior art processes suffers from one or more drawbacks including the use of chemicals, which may create disposal problems; a long fibrillation processing time; and/or a cumbersome hydraulic or mechanical fiber splitting process. Consequently, the prior art split fiber production processes are not highly economical and are not highly suitable for commercial scale productions. In addition, the prior art processes do not tend to produce uniformly split fibers and/or do not provide high levels of fiber splitting.

There remains a need for a production process that is economical and is not deleterious to the environment and that provides high levels of fiber splitting. Additionally, there remains a need for a, fine fiber production process that is continuous and can be used in large commercial-scale productions.

SUMMARY OF THE INVENTION

The present invention provides an in situ process for producing split filaments. The process contains the steps of melt spinning, such as by a spunbond process, multicomponent conjugate filaments including a plurality of distinct cross-sectional segments along their length with at least some adjacent segments being of incompatible compositions, one of which is hydrophilic, and drawing them in the presence of a hot, aqueous split inducing medium so that segments disassociate into fine denier fibers which can be formed into nonwovens. The splittable fibers formed by such plurality of segments and nonwoven fabrics including resulting split fibers are also provided by the invention.

The term "steam" as used herein refers to both steam and a mixture of steam and air, unless otherwise indicated. The term "aqueous medium" as used herein indicates a liquid or gaseous medium that contains water or steam. The term "fibers" as used herein refers to both staple length fibers and continuous filaments, unless otherwise indicated. The term "spunbond fiber nonwoven fabric" refers to a nonwoven fiber fabric of small diameter filaments that are formed by extruding a molten thermoplastic polymer as filaments from a plurality of capillaries of a spinneret. The extruded filaments are cooled while being drawn by an reductive or other well-known drawing mechanism. The drawn filaments are deposited or laid onto a forming surface in a random, isotropic manner to form a loosely entangled fiber web, and then the laid fiber web is subjected to a bonding process to impart physical integrity and dimensional stability. The production of spunbond fabrics is disclosed, for example, in U.S. Pat. Nos. 4,340,563 to Appel et al., 3,802,817 to Matsuki et al. and 3,692,618 to Dorschner et al. Typically, spunbond fibers have a weight-per-unit-length in excess of 2 denier and up to about 6 denier or higher, although finer spunbond fibers can be produced. The term "staple fibers" refers to discontinuous fibers, which typically have an average diameter similar to or somewhat smaller than that of spunbond fibers. Staple fibers are produced with a conventional fiber spinning process and then cut to a staple length, less than about 8 inches. Such staple fibers are subsequently carded or air-laid and thermally or adhesively bonded to form a nonwoven fabric.

DETAILED DESCRIPTION OF THE INVENTION

Figure 1:
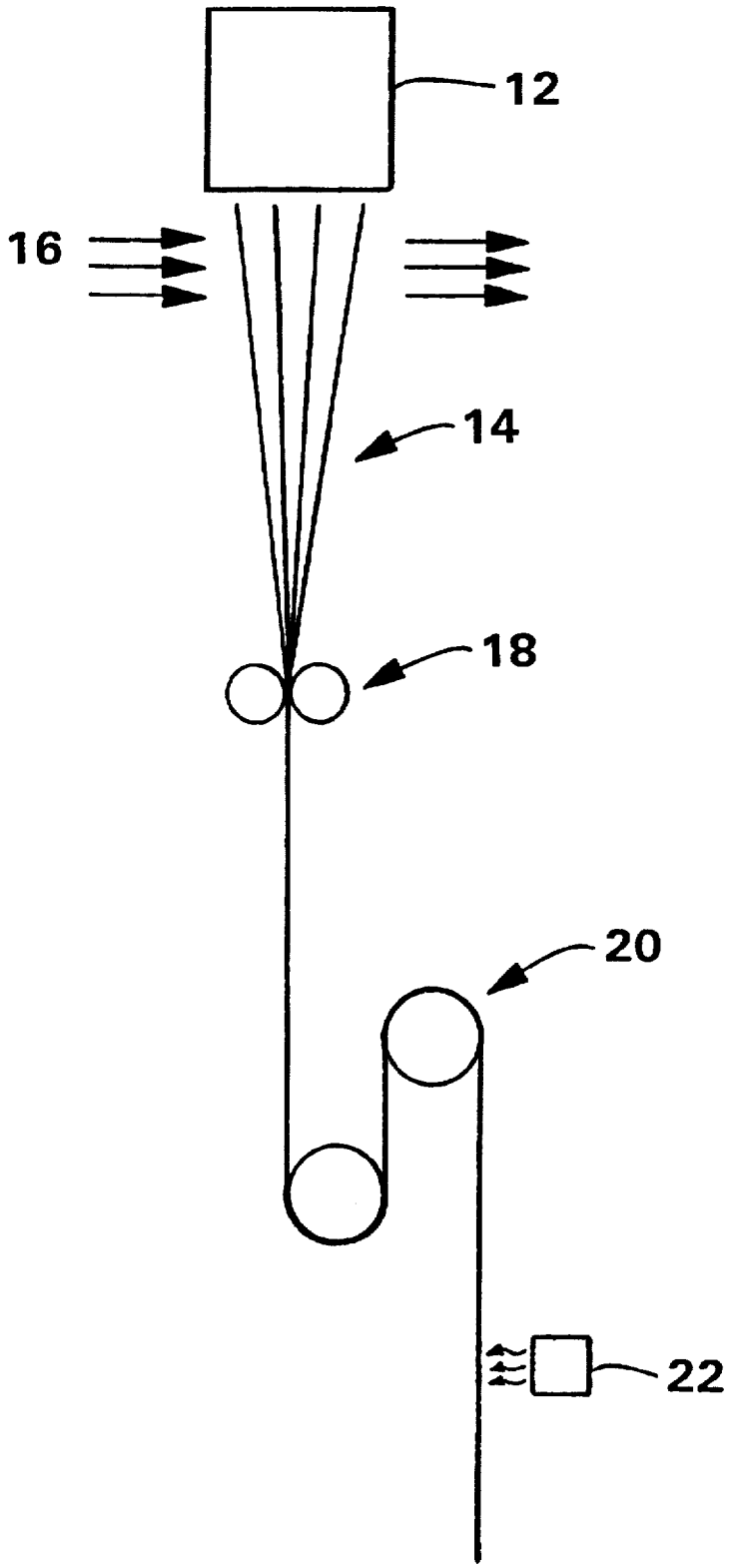
FIG. 1 illustrates one embodiment of a splitting system in accordance with the invention.

The present invention provides an in situ process for producing split filaments. The process has the steps of spinning splittable conjugate filaments and splitting the filaments before the split filaments are further processed, for example, into nonwoven webs, textile filaments or staple fibers. The term "filament spinning process" as used herein indicates a conventional filament spinning process such as spunbonding that uses a spinneret and a filament drawing means to form filaments. The process includes the steps of forming filaments by passing melt-processed polymer compositions through a spinneret, cooling the filaments to substantially solidify the filaments, and then passing the cooled filaments through a drawing unit to attenuate the filaments and to impart molecular orientation in the polymers of the filaments. The attenuating force can be applied mechanically, e.g., with godet rolls as in a continuous filament production process, but is preferably done pneumatically, e.g., with a pneumatic fiber drawing unit as in a spunbond filament production process. The term "substantially solidified" as used herein indicates that at least 50% of the component polymers of the filaments are solidified and the surface temperature of the filaments is lower than the melting point ($T_m$) of the lowest melting component polymer. In accordance with the present invention, each of the splittable filaments contains at least two incompatible polymer component compositions, and at least one of the component compositions is hydrophilic. In addition, the component compositions are arranged to occupy distinct segments across the cross-section of the filament along the length thereof, and at least one segment of the fiber cross-section forms an unocclusive configuration such that the segment is not physically impeded from being separated from the filament. In accordance with the present invention, a conventional conjugate filament spinning process is modified to split the conjugate filaments of the present invention. The modification includes the step of applying a hot aqueous split-inducing medium onto the filaments after the filaments are substantially solidified. Desirably, the filaments are fully solidified before they are subjected to the split-inducing medium. The split-inducing medium is applied just prior to or during the filament drawing step.

The aqueous split-inducing media suitable for the invention include hot water, desirably hot water having a temperature of at least about 60° C. More desirably, the water has a temperature between about 65° C. and 100° C. Additional suitable media are steam and mixtures of steam and air that have a temperature higher than 60° C. but lower than the melting temperature of the lowest melting polymer of the conjugate fiber. When an air and steam mixture medium is utilized, the temperature of the air that is mixed with steam can be adjusted to change the temperature of the fibrillation-inducing medium. For example, the temperature of the air can be elevated to further increase the temperature of the steam-air mixture. The exposure to the aqueous split-inducing medium is controlled as to temperature and dwell time so as to avoid raising the temperature of the fibers above the melting point of the lowest melting component.

Turning to FIG. 1, there is illustrated a mechanically drawing continuous filament production process which has a hot aqueous split-inducing medium applying step. The split filament production apparatus 10 contains a spinneret 12 with spinning apertures through which at least two melt-processed polymer compositions are fed to form conjugate filaments 14. The melt-processed polymer compositions in each of the filaments 14 are arranged to occupy distinct segments across the cross-section of the filament along the length thereof. The compositions are quenched and solidified as the filaments move away from the spinneret 12. Generally, cooling of the filaments 14 is facilitated by a transverse flow of cooling air 16 such that the filaments are substantially solidified when they reach a convergence guide 18. The filaments are then fed to a godet roll or take-up roll drawing assembly 20. Although not preferred, a godet roll assembly 20 may be used to apply a draw-down force on the filaments to draw and to impart molecular orientation in the component polymers of the filaments. Below the godet roll assembly 20, an aqueous medium injection means 22 is placed next to the drawn filaments. The injection means 22 applies an aqueous split-inducing medium onto the filaments such that the filaments are thoroughly contacted with the medium while under a drawing force and the segments of the filament split into split filaments. The split filaments are then processed further into yarns, staple fibers, tows and the like. The split-inducing medium supplied from the injection means 22 can be, for example, steam, a mixture of steam and air, or hot water.

Figure 2:
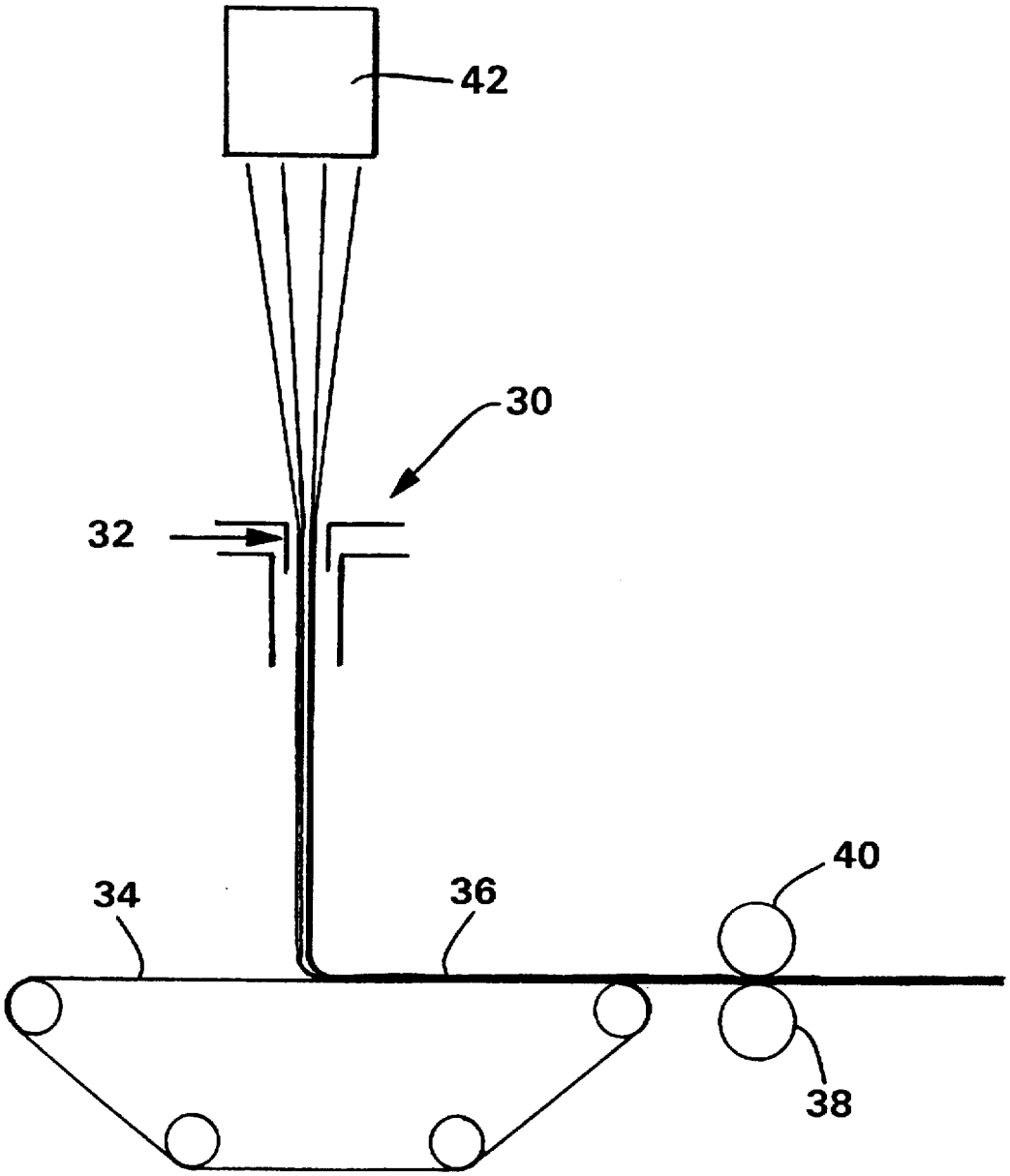
FIG. 2 illustrates a second embodiment including bonding means.

FIG. 2 illustrates a pneumatically draw filament production process modified with a hot aqueous split-inducing medium applying step. More specifically, FIG. 2 illustrates a spunbond nonwoven web production process that applies the split-inducing medium while applying the drawing force. The process uses a spinneret filament production apparatus 42 similar to the above-described continuous filament production apparatus. However, the spunbond apparatus uses a pneumatic drawing unit 30, instead of the godet rolls. Generally described, the pneumatic drawing unit 30 has an elongated vertical passage through which the filaments are passed. In the vertical passage, drawing force is applied to the filaments by a high speed flow of drawing fluid 32, e.g., air, entering from the sides of the passage and flowing downwardly through the passage. Suitable pneumatic drawing units for spunbond apparatus are disclosed, for example, in U.S. Pat. Nos. 3,692,618 to Dorschner et al., 4,340,563 to Appel, et al. and 3,802,817 to Matsuki et al. In accordance with the present embodiment of the invention, the filament drawing air and the split-inducing medium are simultaneously applied through the pneumatic drawing unit 30, thereby drawing and splitting the conjugate filaments simultaneously. The drawing air and the split-inducing medium can be supplied as a mixture, or a split-inducing medium can used as both the drawing air and the split-inducing medium.

The drawn, split filaments exiting the pneumatic unit 30 can be directly deposited on a forming surface 34 in random fashion to form a nonwoven web 36. The nonwoven web is then bonded using a conventional bonding process suitable for spunbond webs, e.g., calender bonding process, point bonding process and ultrasonic bonding process, to impart strength properties and physical integrity in the web. Additionally, a through-air bonding process can be utilized. FIG. 2 further illustrates an exemplary bonding process—a pattern bonding process. The pattern bonding process employs at least two adjacently placed pattern bonding rolls 38, 40 for imparting bond points or regions at limited areas of the web by passing the web through the nip formed by the bonding rolls 38, 40. One or both of the roll pair may have a pattern of land areas and depressions on the surface and may be heated to an appropriate temperature.

The bonding roll temperature and the nip pressure are selected so as to effect bonded regions without having undesirable accompanying side effects such as excessive shrinkage and web degradation. Although appropriate roll temperatures and nip pressures are generally influenced by parameters such as web speed, web basis weight, fiber characteristics, component polymers and the like, the roll temperature desirably is in the range between the softening point and the crystalline melting point of the lowest melting component polymer. For example, desirable settings for bonding a fiber web that contains split polypropylene fibers, e.g., a web of polypropylene and polyamide split fibers, are a roll temperature in the range of about 125° C. and about 160° C. and a pin pressure on the fabric in the range of about 350 kg/cm and about 3,500 kg/cm$^2$. Other exemplary bonding processes suitable for the present split fiber web are through-air bonding processes if the conjugate filaments are produced from component compositions having different melting points. A typical through-air bonding process applies a flow of heated air onto the split fiber web to raise the temperature of the web to a level higher than the melting point of the lowest melting polymer of the web but below the melting point of the highest melting polymer of the web. A through-air bonding process may be employed so as not to apply any significant compacting pressure and, thus, is highly suitable for producing a lofty bonded fabric particularly if the fibers are crimped. As another embodiment of the invention, the pneumatic drawing unit of a spunbond process can also be used to impart crimps in the filaments in addition to drawing and splitting the filaments if the component polymers for the conjugate filaments are selected from polymers having different thermal shrinkage properties. When conjugate filaments are produced from polymers having different shrinkage properties, they form latent crimpability. The latent crimpability can be activated by utilizing heated drawing air or steam in the pneumatic drawing unit. The appropriate temperature of drawing air will vary depending on the selected component polymers. In general, a higher temperature produces a higher level of crimp, provided that the fluid temperature is not so high as to melt the component polymers. U.S. Pat. No. 5,382,400 to Pike et al. discloses a suitable process for producing conjugate fibers and webs produced therefrom, which patent is herein incorporated in its entirety by reference.

In accordance with the present invention, the splittable conjugate filaments can be characterized in that at least one of the component polymer compositions of the conjugate filament is preferably hydrophilic. Hydrophilic polymers suitable for the present conjugate filament component compositions include both hydrophilic polymers and hydrophilically modified polymers. When hydrophobic or insufficiently hydrophilic polymers are utilized, at least one of the polymers needs to be hydrophilically modified. Desirably, the hydrophilic polymer component has an initial contact angle equal to or less than about 80°, more desirably equal to or less than about 75°, even more desirably equal to or less than about 60°, most desirably equal to or less than about 50°. The hydrophilicity of the hydrophilic component polymer can be measured in accordance with the ASTM D724-89 contact angle testing procedure on a film produced by melt casting the polymer at the temperature of the spin pack that is used to produce the conjugate filaments. The term "initial contact angle" as used herein indicates a contact angle measurement made within about 5 seconds of the application of water drops on a test film specimen.

Inherently hydrophilic polymers suitable for the present invention include thermoplastic polymers having the above-specified hydrophilicity. Such polymers include copolymers of caprolactam and alkylene oxide diamine, e.g., Hydrofil® nylons, which are commercially available from Allied-Signal Inc.; copolymers of poly(oxyethylene) and polyurethane, polyamide, polyester or polyurea, e.g., absorbent thermoplastic polymers disclosed in U.S. Pat. No. 4,767,825 to Pazos et al.; ethylene vinyl alcohol copolymers; and the like. U.S. Pat. No. 4,767,825 in its entirety is herein incorporated by reference.

Hydrophilically modifiable polymers suitable for the present invention include polyolefins, polyesters, polyamides, polycarbonates and copolymers and blends thereof. Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene, and blends thereof; polybutylene, e.g., poly (1-butene) and poly(2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include polyethylene terephthalate, polybutylene terephthalate, polytetramethylene terephthalate, polycyclohexylene-1,4-dimethylene terephthalate, and isophthalate copolymers thereof, as well as blends thereof.

In accordance with the present invention, when a hydrophobic or insufficiently hydrophilic polymer is selected as the hydrophilic component of the splittable conjugate fiber, the polymer must be hydrophilically or wettably modified. One useful means for modifying the polymer is adding a hydrophilic modifying agent or hydrophilic modifier that renders the polymer hydrophilic. Suitable hydrophilic modifiers include various surfactants. Depending on the final use of the split fiber material, the surfactants can be fugitive or nonfugitive. Fugitive surfactants, i.e., surfactants that wash off from the fiber surface, are suitable if the split fibers are used in single exposure applications or applications in which nonwettable or hydrophobic properties are desired, and nonfugitive surfactants, i.e., surfactants that permanently or semipermanently adhere to the fiber surface, are suitable if the split fibers are used in applications in which more durably wettable or hydrophilic properties are desired. In addition, particularly suitable internally added surfactants are selected to have a low compatibility with the polymer of the hydrophilic component of the fiber since such surfactants readily migrate to the surface of the fiber during the fiber spinning process. When a surfactant having a slow migration characteristic is utilized, the fibers may need to be heat treated or annealed to facilitate the migration of the surfactant to the surface. Such heat treatment is known in the art as a "blooming" process. Illustrative examples of suitable surfactants include silicon based surfactants, e.g., polyalkylene-oxide modified polydimethyl siloxane; fluoroaliphatic surfactants, e.g., perfluoroalkyl polyalkylene oxides; and other surfactants, e.g., actylphenoxypolyethyoxy ethanol nonionic surfactants, alkylaryl polyether alcohols, and polyethylene oxides. Commercially available surfactants suitable for the present invention include various poly(ethylene oxide) based surfactants available under the tradename Triton®, e.g., grade X-102, from Rohm and Haas Corp.; various polyethylene glycol based surfactants available under the tradename Emerest®, e.g., grades 2620 and 2650, from Emery Industries; various polyalkylene oxide modified polydimethylsiloxane based surfactants available under the tradename Masil®, e.g., SF-19, which is available from Mazer; polyalkylene oxide fatty acid derivatives available under the tradename PEG®, e.g. PEG 400, which is available from ICI; sorbitan monooleate, e.g., Span 80, which is available from ICI; ethoxylated hydroxylated castor oil, e.g., G1292, which is available from ICI; a mixture of sorbitan monooleate and ethoxylated hydroxylated castor oil, e.g., Ahcovel ® Base N62, which is available from ICI; polyoxyalkylene modified fluoroaliphatic surfactants which are available, e.g., from Minnesota Mining and Manufacturing Co.; and mixtures thereof.

The amount of surfactants required and the hydrophilicity of modified filaments for each application will vary depending on the type of surfactant and the type of polymer used. In general, filaments containing more hydrophilic or hydrophilically modified polymer components result in more spontaneous splitting. Consequently, a high level of a surfactant can be added to the polymer composition of the conjugate fibers provided that the surfactant level is not too high as to adversely affect the processibility of the polymer composition. Typically, the amount of the surfactant suitable for the present fiber composition is in the range of from about 0.1% to about 5%, desirably from about 0.3% to about 4%, by weight based on the weight of the polymer composition. The surfactant is thoroughly blended with the polymer composition before the composition is processed into filaments. For example, when a melt-extrusion process for producing filaments is utilized, the surfactant is blended and melt-extruded with the polymer compositions in extruders and then spun into filaments.

In accordance with the present invention, additional component polymers for the conjugate filaments are selected from hydrophilic and hydrophobic thermoplastic polymers that are incompatible with the hydrophilic component polymer of the conjugate fibers. Suitable polymers include the above illustrated hydrophilic polymers and hydrophobic polymers that are suitable for the hydrophilic component, provided that they are incompatible with the hydrophilic component polymer.

The term "incompatible polymers" as used herein indicates polymers that do not form or stay as a miscible blend, i.e., immiscible, when melt blended. As a desirable embodiment of the present invention, differences in the polymer solubility parameter (δ) are used to select suitably incompatible polymers. The polymer solubility parameters (δ) of different polymers are well known in the art. A discussion of the solubility parameter is, for example, disclosed in *Polymer: Chemistry and Physics of Modern Materials,* pages 142–145, by JMG Cowie, International Textbook Co., Ltd., 1973. Desirably, the adjacently disposed polymer components of the present conjugate fiber have a difference in the solubility parameter of at least about 0.5 $(cal/cm^3)^{1/2}$, more desirably at least about 1 $(cal/cm^3)^{1/2}$, most desirably at least about 2 $(cal/cm^3)^{1/2}$. The upper limit of the solubility parameter difference is not critical for the present invention since the higher the difference, the more spontaneous the splitting of the filament becomes.

Illustrative examples of particularly desirable pairs of incompatible polymers useful for the present invention include polyolefin-polyamide, e.g., polyethylene-nylon 6, polyethylene-nylon 6/6, polypropylene-nylon 6, polypropylene-nylon 6/6, polyethylene-a copolymer of caprolactam and alkylene oxide diamine, and polypropylene -a copolymer of caprolactam and alkylene oxide diamine; polyolefin-polyester, e.g., polyethylene-polyethylene terephthalate, polypropylene-polyethylene terephthalate, polyethylene-polybutylene terephthalate and polypropylene-polybutylene terephthalate; and polyamide-polyester, e.g., nylon 6-polyethylene terephthalate, nylon 6/6-polyethylene terephthalate, nylon 6-polybutylene terephthalate, nylon 6/6-polybutylene terephthalate, polyethylene terephthalate-a copolymer of caprolactam and alkylene oxide diamine, and polybutylene terephthalate-a copolymer of caprolactam and alkylene oxide diamine.

Fabrics or webs containing the present split filaments or staple fibers provide a combination of desirable textural properties of conventional microfiber fabrics and desirable strength properties of highly oriented fiber fabrics. Especially with spunbond processes the split fiber fabric obtained by splitting prior to web forming exhibits desirable properties, such as uniformity of the fabric, uniform fiber coverage, barrier properties and high fiber surface area, that are akin to microfiber fabrics. In addition, unlike microfiber fabrics such as meltblown webs, the split fiber fabric also exhibits highly desirable strength properties, desirable hand and softness and can be produced to have different levels of loft. Many uses will be apparent, such as filter media, sorbent products, geotextiles, housewrap, synthetic paper, barrier and breathable barrier fabrics for personal care products and the like.

Furthermore, the present split fiber production process is highly advantageous over prior art split fiber production processes. The present process is a flexible, noncompacting process that can be used to produce split fiber fabrics having a wide variety of loft and density. Unlike prior art needling processes for splitting fibers that inherently compact the precursor web, the present process does not apply compacting forces to split conjugate fibers. Accordingly, the present process does not alter the loft of the precursor fiber web or fabric during the fiber splitting process. In addition, the present process does not sacrifice the strength properties of the precursor fiber web. Unlike prior art solvent dissolving processes for producing fine fibers, the present process retains all of the polymeric components of the precursor conjugate fibers during the fiber splitting process. Consequently, the present process at least retains or even improves strength properties of the precursor web. This is because the present process retains the polymeric components of the precursor web while increasing the number of fiber strands, and because, as is known the art, a fabric having a higher number of fiber strands and thus having finer fibers is stronger than a coarse fiber fabric of the same polymer, the same basis weight and a similar level of molecular orientation and binding.

Fabrics containing the split fine fibers that exhibit the above-illustrated desirable properties are highly suitable for various uses as mentioned. For example, nonwoven fabrics containing the split fine fibers are highly suitable for various additional uses including disposable articles, e.g., protective garments, sterilization wraps, wiper cloths and covers for absorbent articles; and woven fabrics containing the split fine fibers that exhibit highly improved softness and uniformity are highly useful for soft apparels, dusting and wiper cloths and the like.

As another embodiment of the present invention, the soft, strong fine fiber fabric may be used as a laminate that contains at least one layer of the fine fiber fabric and at least one additional layer of another woven or nonwoven fabric or a film. The additional layer for the laminate is selected to impart additional and/or complementary properties, such as liquid and/or microbe barrier properties. The layers of the laminate can be bonded to form a unitary structure by a bonding process known in the art to be suitable for laminate structures, such as a thermal, ultrasonic or adhesive process.

A laminate structure highly suitable for the present invention is disclosed in U.S. Pat. No. 4,041,203 to Brock et al., which is herein incorporated in its entirety by reference. In adapting the disclosure of U.S. Pat. No. 4,041,203, a pattern bonded laminate of at least one split continuous filament nonwoven web, e.g., split spunbond conjugate fiber web, and at least one microfiber nonwoven web, e.g., meltblown web, can be produced; and such laminate combines the strength and softness of the split fiber fabric and the breathable barrier properties of the microfiber web. Alternatively, a breathable film can be laminated to the fine fiber web to provide a breathable barrier laminate that exhibits a desirable combination of useful properties, such as soft texture, strength and barrier properties. As yet another embodiment of the present invention, the fine fiber fabric can be laminated to a non-breathable film to provide a strong, high barrier laminate having a cloth-like texture. These laminate structures provide desirable cloth-like textural properties, improved strength properties and high barrier properties. The laminate structures, consequently, are highly suitable for various uses including various skin-contacting applications, such as protective garments, covers for diapers, adult care products, training pants and sanitary napkins, various drapes, and the like.

The following example is provided for illustration purposes and the invention is not limited thereto.

EXAMPLE

Hydrophilic modifying agent used:

SF-19-ethoxylated polysiloxane, which is available from Mazer. SF-19 exhibited a contact angle of about 0°.

Testing Procedure:

Contact Angle—measured in accordance with ASTM D724-89 using a 0.05 mm cast film produced from Exxon's 3445 Polypropylene.

EXAMPLE 1

Crimped conjugate spunbond filaments having a parent or initial denier of about 2 and including 50% by weight linear low density polyethylene and 50% by weight nylon 6 and having a side-by-side configuration were produced. The linear low density polyethylene (LLDPE) was Dow Chemical's LLDPE 6811A, and the nylon 6 used was custom polymerized polycaprolactam, which was produced by Nyltech, Manchester N.H., and had a formic acid relative viscosity of 1.85. LLDPE was blended with 2% by weight of $TiO_2$ concentrate containing 50% by weight $TiO_2$ and 50% by weight of polypropylene, and the mixture was fed into a first single screw extruder. In addition, 2% by weight of SF-19 surfactant, as indicated in Table 1, was blended with the LLDPE composition before the composition was fed into the extruders. The composition for Example 1 is shown in Table 1. The melt temperature of the LLDPE extrudate was about 232° C., and the melt temperature of the nylon 6 extrudate was about 232° C.

The extruded polymers were fed to a bicomponent spinning die and spun into round bicomponent fibers in accordance with the bicomponent spunbond fiber production process disclosed in afore-mentioned U.S. Pat. No. 5,382,400. The bicomponent spinning die had a 0.6 mm spinhole diameter and a 4:1 L/D ratio. The spinhole throughput rate was 0.5 gram/hole/minute. The spinning die was maintained at 232° C. The bicomponent filaments exiting the spinning die were quenched by a flow of air having a flow rate of 0.5 $m^3$/min./cm spinneret width and a temperature of 18° C. The quenching air was applied about 5 inches (about 12.7 cm) below the spinneret, and the quenched fibers were drawn in an aspirating unit of the type which is described in U.S. Pat. No. 3,802,817 to Matsuki et al. The quenched filaments were drawn with the flow of a 50:50 mixture of air and steam, which was heated to about 93° C., in the aspirating unit to attain crimped filaments of about 1 denier after splitting. The drawn filaments were deposited onto a foraminous forming surface, forming a lofty web of filaments.

TABLE 1

| | Modifier | | | | |
|---|---|---|---|---|---|
| Example | Name | Contact Angle | % in LLDPE | % in Nylon 6 | % Split* |
| Ex1 | SF-19 | 0° | 2 | 0 | 75% |

*This is a visually estimated % based on the ratio of the number of conjugate fiber that are split over the number of total conjugate fibers.

What is claimed is:

1. A process for producing split fibers, said process comprising:

a) melt spinning multicomponent conjugate filaments comprising a multitude of distinct cross-sectional segments along the length of said filaments, wherein adjacent distinct segments comprise incompatible polymer compositions at least one of which is hydrophilic; and b) drawing the conjugate filaments in the presence of a aqueous fibrillation-inducing medium to split the filaments;

wherein said segments have an unocclusive configuration such that said segments are dissociable, and said segments dissociate in less than about 30 seconds when contacted with a hot aqueous fibrillation-inducing medium.

2. The process for producing split fibers of claim 1 wherein at least one of said polymer compositions further comprises a hydrophilic modifier.

3. The process for producing split fibers of claim 2 wherein said incompatible polymer compositions comprise a first polymer composition, which comprises a first thermoplastic polymer, and a second polymer composition, which comprises a second thermoplastic polymer; and said first and second polymers are selected from polyolefin-polyamide, polyolefin-polyester and polyamide-polyester pairs.

4. The process for producing split fibers of claim 3 wherein said hydrophilic modifier is a surfactant.

5. The process for producing split fibers of claim 4 wherein said surfactant provides a water contact angle equal to or less than about 50° as measured in accordance with ASTM D724-89.

6. The process for producing split fibers of claim 5 wherein at least one of said first and second polymer compositions contains said surfactant between about 0.1% and about 5% based on the total weight of said polymer composition.

7. The process for producing split fibers of claim 3 wherein said first and second polymers have a solubility parameter difference of at least about 0.5 $(cal_{th}cm^{-3})^{1/2}$.

8. The process for producing split fibers of claim 1 wherein said hot fibrillation-inducing medium comprises water or steam having a temperature of at least about 60° C.

9. A fabric comprising split fibers produced with the process of claim 1.

10. A spunbond process in accordance with claim 1.

11. A spunbond process in accordance with claim 10 wherein at least one of said polymer compositions further comprises a hydrophilic modifier.

12. A spunbond process in accordance with claim 11 wherein said incompatible polymer compositions comprise a first polymer composition, which comprises a first thermoplastic polymer, and a second polymer composition, which comprises a second thermoplastic polymer; and said first and second polymers are selected from polyolefin-polyamide, polyolefin-polyester and polyamide-polyester pairs.

13. A spunbond process in accordance with claim 12 wherein said hydrophilic modifier is a surfactant.

14. A spunbond process in accordance with claim 13 wherein said surfactant provides a water contact angle equal to or less than about 50° as measured in accordance with ASTM D724-89.

15. A spunbond process in accordance with claim 14 wherein at least one of said first and second polymer compositions contains said surfactant between about 0.1% and about 5% based on the total weight of said polymer composition.

16. A spunbond process in accordance with claim 12 wherein said first and second polymers have a solubility parameter difference of at least about 0.5 $(cal_{th}cm^{-3})^{1/2}$.

17. A spunbond process in accordance with claim 10 wherein said hot fibrillation-inducing medium comprises steam and is the drawing medium.

18. A fabric comprising split fibers produced in accordance with the process of claim 10.

19. A personal care product comprising the nonwoven fabric of claim 9.

20. A personal care product comprising the nonwoven fabric of claim 18.

21. A personal care product comprising split fibers made in accordance with the process of claim 3.

22. A filter medium comprising split fibers made in accordance with the process of claim 3.

23. A nonwoven fabric comprising fibers that have been split from multicomponent fibers by drawing said multicomponent fibers under hot aqueous conditions wherein at least two of said multicomponents have a difference in solubility parameters of at least about 0.5 $(cal/cm^3)^{1/2}$.

24. The nonwoven fabric of claim 23 wherein said difference in solubility parameters is at least about 2 $(cal/cm^3)^{1/2}$.

* * * * *